United States Patent [19]

Bloom

[11] Patent Number: 4,743,197

[45] Date of Patent: May 10, 1988

[54] HIGH TEMPERATURE FAN PLUG APPARATUS

[75] Inventor: William M. Bloom, Pittsburgh, Pa.

[73] Assignee: Allegheny Ludlum Corporation, Pittsburgh, Pa.

[21] Appl. No.: 47,966

[22] Filed: May 8, 1987

[51] Int. Cl.[4] ..... F27B 9/28

[52] U.S. Cl. ..... 432/59; 432/164; 432/8; 415/177; 415/178

[58] Field of Search ..... 415/177, 178; 432/8, 432/18, 59, 164

[56] References Cited

U.S. PATENT DOCUMENTS

| | | | |
|---|---|---|---|
| 1,410,644 | 3/1922 | Bentley | 415/177 |
| 1,773,909 | 8/1930 | Korb | 415/177 |
| 2,686,665 | 8/1954 | Tauber et al. | 415/177 |
| 3,186,345 | 6/1965 | Ivanoff | 415/178 |
| 3,310,940 | 3/1967 | Oetliker | 415/177 |
| 3,578,873 | 5/1971 | Baez | 415/177 |
| 4,069,008 | 1/1978 | Bloom | 432/8 |

*Primary Examiner*—Henry C. Yuen

*Attorney, Agent, or Firm*—Patrick J. Viccaro

[57] ABSTRACT

A high temperature fan plug for a jet heat recuperator includes inner and outer face plates spaced apart by tubular spacers extending between the plates to form a heat insulative cavity. A fastener bolt extends from one face plate through a tubular spacer and projects from the other face plate. A spring with washers at opposite ends thereof is compressed by nut members on the end of the bolt which projects from the face plate for clamping the outer and inner face plates against the spacers. A hub structure carried by the inner and outer face plates receives a seal. The face plate exposed to high temperatures in the recuperator extends between spaced apart rings that are secured to a rim that is in turn carried by the other of the face plates. The rings slidably engage the outer peripheral portion of the face plate exposed to the high temperature environment.

7 Claims, 4 Drawing Sheets

HIGH TEMPERATURE FAN PLUG APPARATUS

BACKGROUND OF THE INVENTION

This invention relates to apparatus for heating a workpiece and more particularly to an improved fan plug assembly embodying a construction and arrangement of parts to withstand a high temperature environment as well as large and rapid temperature changes occurring in an associated heat recovery structure such as a jet heat recuperator.

While not so limited, the fan plug apparatus of present invention is useful in a jet heat recuperator of the type disclosed in my prior U.S. Pat. No. 4,069,008. A jet heat recuperator utilizes, sensable heat of waste gases for heating a workpiece such as steel strip. The recuperator includes a horizontal heating chamber with top and bottom perforated plates forming gaseous discharge members of top and bottom waste gas chambers enclosed by outer refractory walls. Between the refractory walls and the lateral sides of the strip heating chamber are vertical side plates which form side sections. One side section communicates with the top waste gas chamber and the other side section communicates with the bottom waste gas chamber. Each side section is provided with a fan having a drive shaft that extends externally of the recuperator by extending through a fan plug apparatus. The fans in the side sections are driven by motors supported on pedestals located externally of the furnace. The fan plug units form closures for the relatively large openings in the refractory lined side walls of the recuperator. Usually a plug assembly is made up of inner and outer sheets of metal that are held apart by an outer peripheral rim. The interior space enclosed by the sheets can be filled with heat insulative material. In some installations a plug unit operates within a housing of an assembly other than a jet heat recuperator under conditions of an established rate of temperature change. One useful purpose of this thermal insulation in the wall of the fan plug assembly is to protect the motor drive arrangement for the fan.

When, for example, jet heat recuperators are used in a strip processing line to heat metal strip and while trip travel is stopped, it is necessary to stop the strip heating process until strip travel is restarted. To avoid overheating the strip, fast acting control valves may be used to stop the supply of combustible fuel for supplying hot waste gases as a heat supply. Such valves can operate to reapply the required fuel input for the combustion process within a very short period of time whereby the recuperators are subject to rapid temperature changes. In this type of environment, the refractory lining of the recuperator can take the form of refractory fibers having a very low heat storage characteristic as compared with refractory brick, the ratio being 1 to 15 up to 1 to 35. In this way heating costs can be significantly reduced and linings made thinner with less weight. However, it was discovered that when the strip processing line is stopped and the supply of high temperature gases is restarted, a 1400 degree Fahrenheit temperature increase occurred in the recuperation within a one minute interval. The temperature in the recuperator increased from 500 degrees to 1900 degrees Fahrenheit. The reduction in the amount of heat stored by the refractory material as well as effective thermal insulation in the insulated plug assembly has brought about the realization that conventional designs of the insulated plug assembly are inadequate. It has been found that the face plate of the plug assembly situated towards the high temperature environment in the recuperator heats up faster and expands before the outer face plate directed toward the atmosphere; causing the face plate at the high temperature to bow towards the rotating fan. The distortion of this face plate can be large enough that contact is made between the plate and the fan. Attaching stiffeners to the face plate is inadequate because welds or fasteners used to secure the stiffeners to the plates break loose after a period of time; again permitting the surface of the face plate to move and contact the rotating fan wheel. When this occurs the fan and the plug assembly can be severely damaged and usually destroyed.

It is therefore an object of the present invention to provide an improved construction and an arrangement of parts for a fan plug assembly having a face surface thereof free from thermal distortion when exposed to a high temperature environment while the hot face surface thereof is spaced from and supported by a second face plate which is directed to atmospheric air or the like.

SUMMARY OF THE INVENTION

According to the present invention there is provided a high temperature fan plug assembly forming a side wall closure for a fan to operate in a furnace or the like wherein the plug assembly includes inner and outer face plates spaced apart by spacers extending between the plates and forming a cavity for a heat insulative barrier, fastening means for clamping the outer and inner face plates against the spacers, hub means carried by the inner and outer face plates for carrying a seal for a drive shaft of the fan, and a rim means secured to one of the inner and outer face plates for slidably engaging an outer peripheral portion of the other of the face plates.

Preferably the rim means includes a curved rim plate carrying spaced apart rings on an inner face surface thereof to form a gap therebetween wherein the outer peripheral portion of the face plate can seat for radial expansion. The fastening means preferably takes a form of bolt members passed through aligned openings in the inner and outer face plates with an end portion of each bolt extending from one of the face plates. A compression spring is interposed between a face plate and a nut member threadably attached to the end portion of each bolt so that a resilient clamping force is developed between the face plates. In this way the space between the plate which can be filled with heat insulation material can be maintained at substantial constant dimensional relationship and at the same time thermal expansion of one of the face plates relative to the other face plate can occur without warping or distortion during the expansion process.

BRIEF DESCRIPTION OF THE DRAWINGS

These features and advantages of the present invention as well as others will be more fully understood when the following description is read in light of the accompanying drawings in which.

DESCRIPTION OF THE PREFERRED EMBODIMENT

Figure 2:
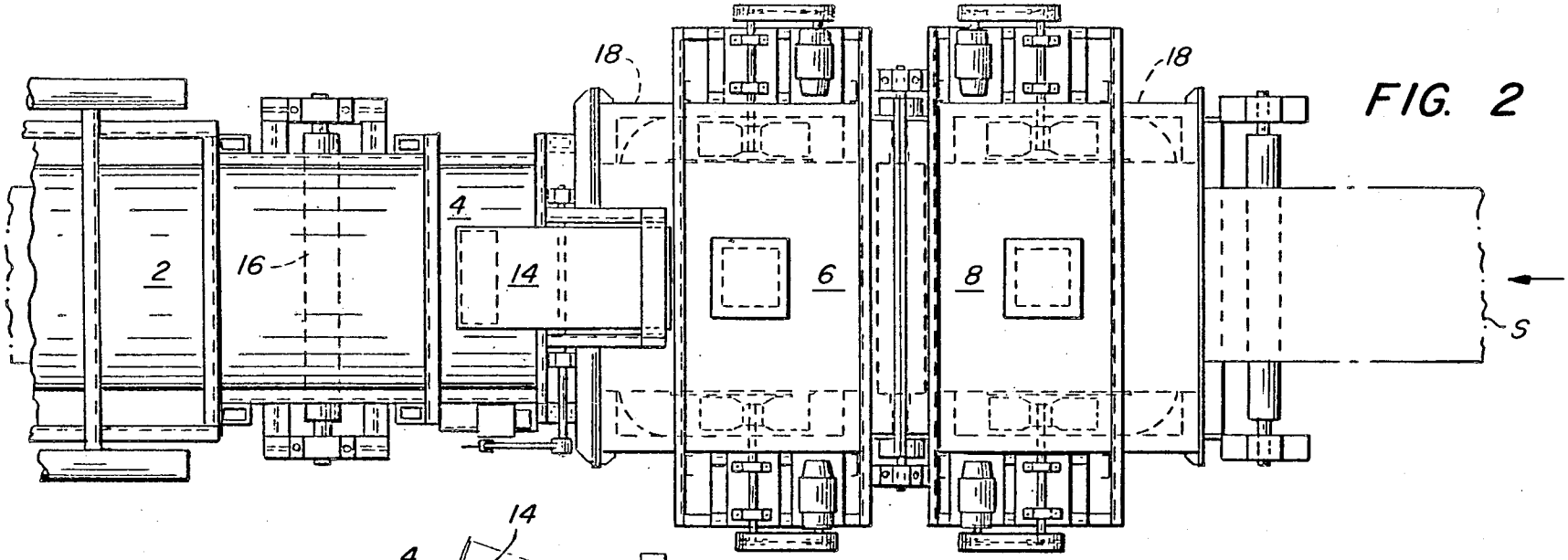
FIG. 2 is a plan view of the assembly shown in FIG. 1.
Figure 1:
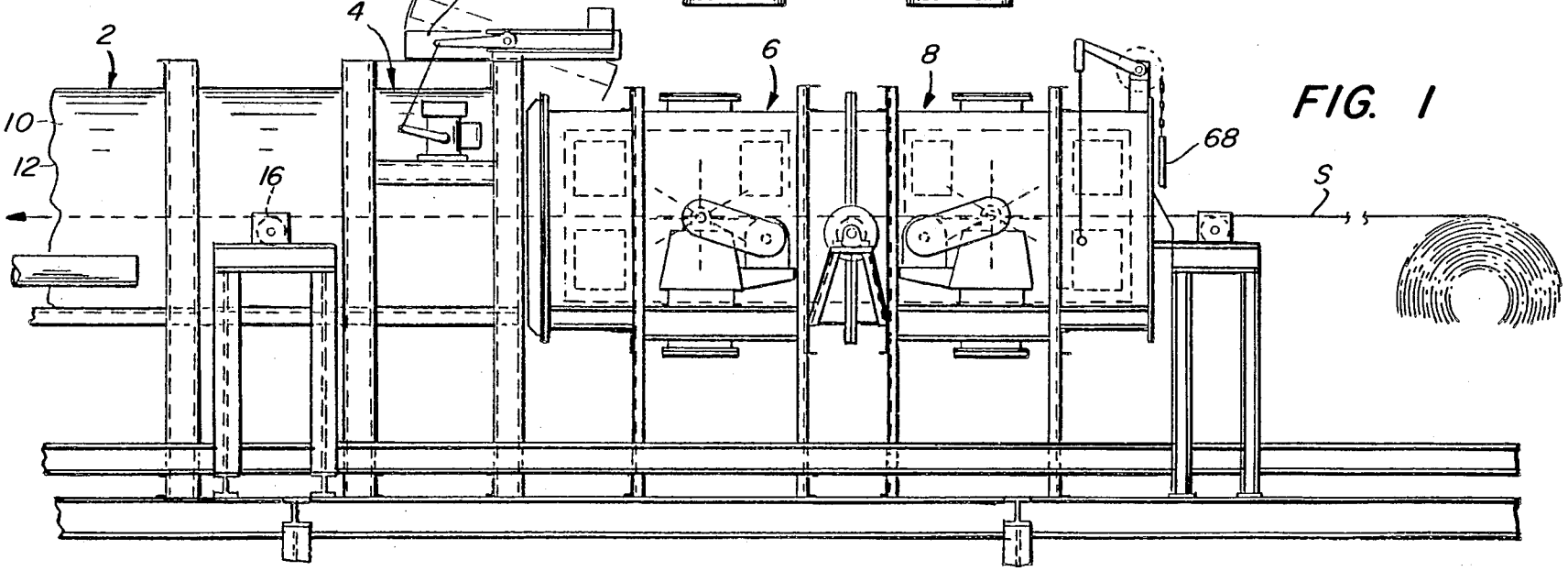
FIG. 1 is a longitudinal elevation of the entry end of the furnace assembly which includes a jet heat recuperator embodying the present invention.
Figure 3:
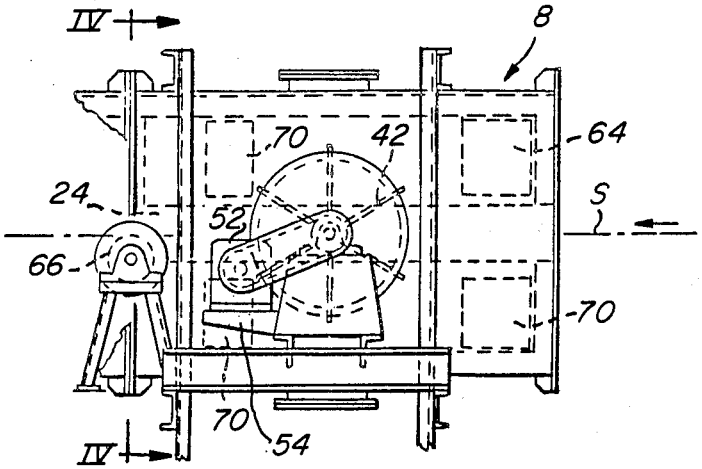
FIG. 3 is a view taken along lines 3—3 of FIG. 2.
Figure 4:
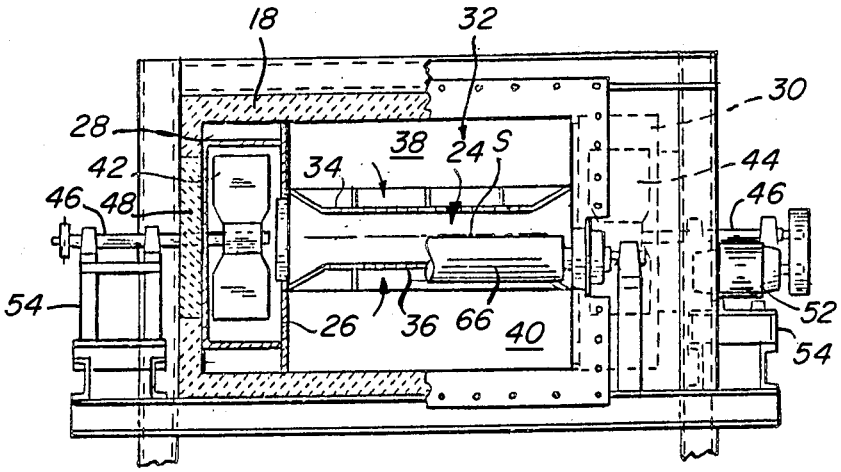
FIG. 4 is a view taken along lines 4—4 of FIG. 3.
Figure 5:
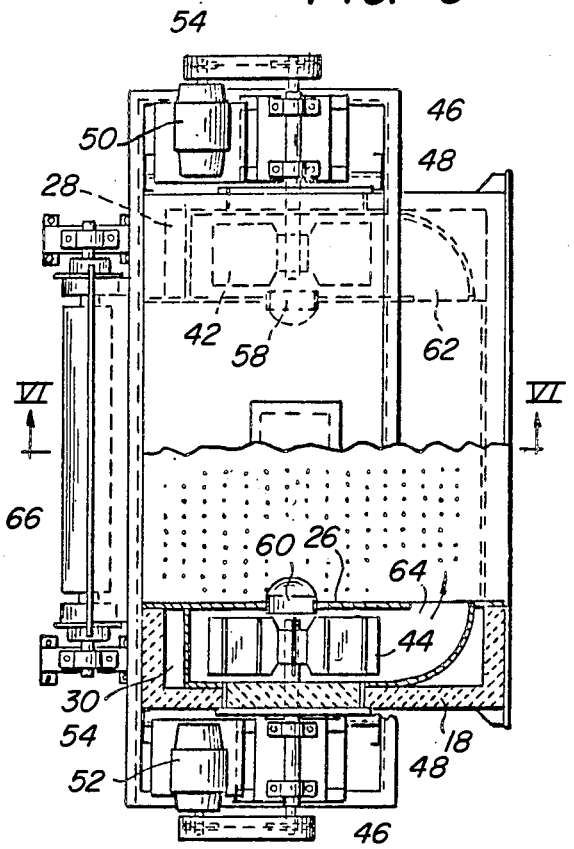
FIG. 5 is a plan view of a jet heat recuperator with parts broken away and shown in section.
Figure 6:
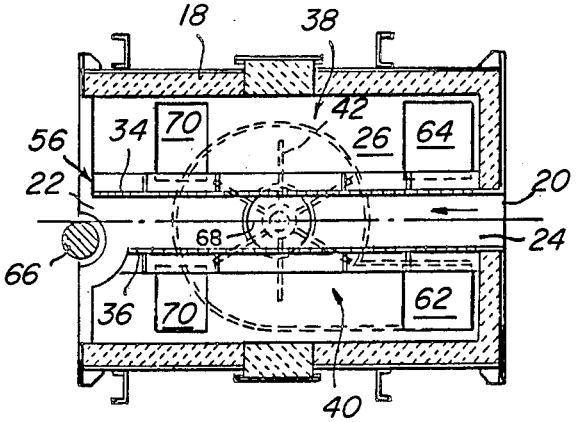
FIG. 6 is a sectional view taken along lines 6—6 of FIG. 5.

Referring now to the drawings and particularly to FIGS. 1 and 2 thereof, there is illustrated a furnace 2 for heating strip S such as steel or stainless steel which passes through the furnace from right to left when viewing FIGS. 1 and 2. Reference numeral 4 identifies an intermediate unfired furnace section at the entry end of furnace 2. At the entry end of the unfired section 4 there are two jet recuperators 6 and 8 in tandem.

Furnace 2 includes a spring refractory arch 10 forming a heating chamber 12 wherein fuel fired burners, which can be conventional natural gas burners, are arranged along the length of the furnace at each of opposite lateral sides thereof. At the strip discharge end of the furnace, the opening thereof is provided with a seal and a roller, not shown, to prevent the escape of cost of the hot waste gases to the atmosphere. The unfired furnace section 4 is basically the same in cross section as furnace 2 but does not have any burners. A roof dampener 14 at the inlet end of furnace 4 is closed except for during start up when no strip is present in the line. Roll 16 support strip at the exit end of furnace 4.

Figure 7:
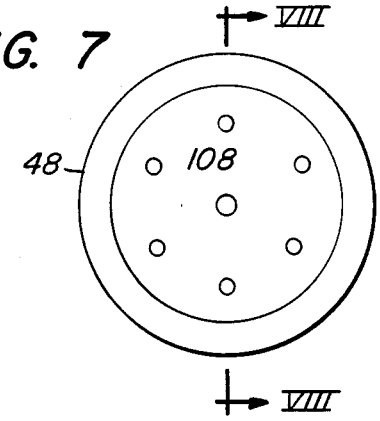
FIG. 7 is an outer elevational view of a high temperature fan plug assembly of the present invention.
Figure 8:
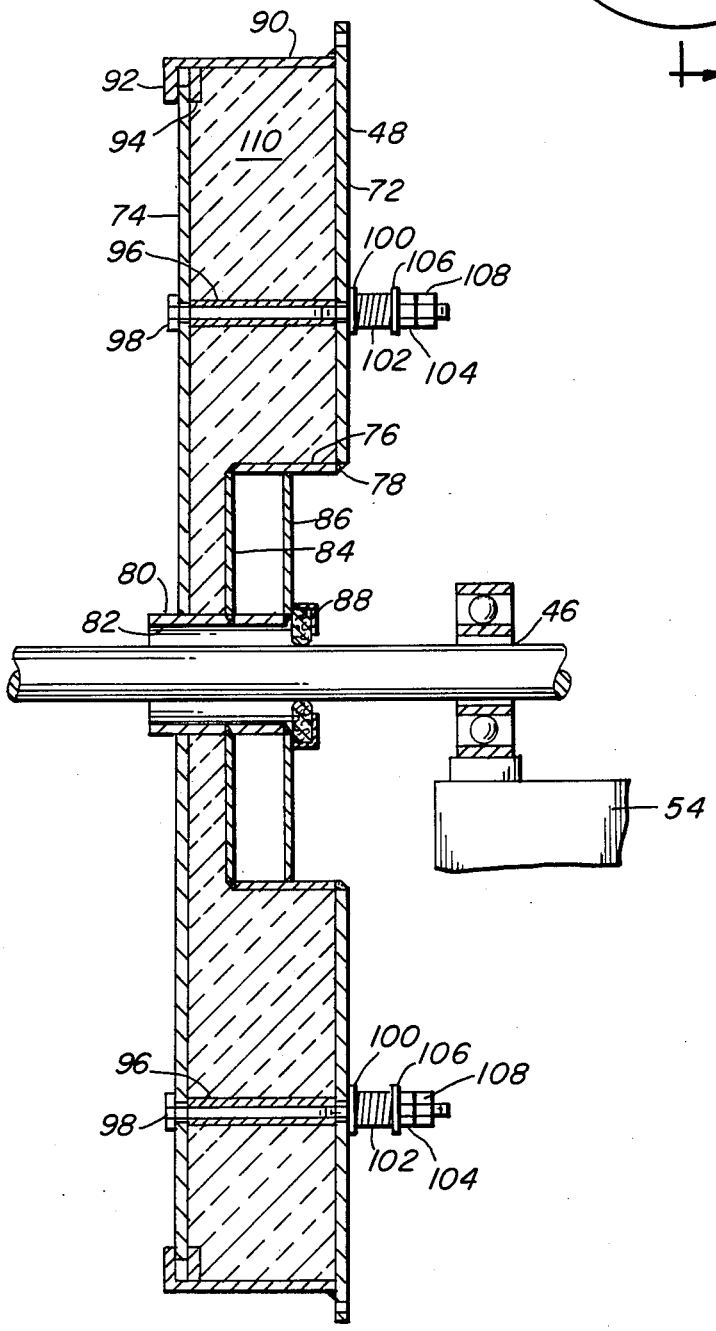
FIG. 8 is an enlarged sectional view taken along lines of 8—8 of FIG. 7.

At the strip entrance of the unfired furnace 4 there the jet heat recuperators 6 and 8 embody the same construction and each recuperator includes refractory walls 18 with end openings 20 and 22 extending into a heating chamber 24. Spaced vertical plate 26 divide the recuperator into side sections 28 and 30 and a central section 32. Top and bottom perforated plates 34 and 36 extend between plates 26 to form a strip heating chamber 24 in section 32, a top waste gas chamber 38 and a bottom waste gas chamber 40. The plates 34 and 36 are provided with rows of spaced apart hot gas discharge holes. The size and spacing of the holes are selected in a dependent relation to the temperature and volume of the hot waste gases. Fans 42 and 44 are arranged in chambers 28 and 30, respectively. The fans each include a drive shaft 46 which extends externally of the recuperator by passing through a suitable opening in an insulated plug assembly 48 which is best shown in FIGS. 7 and 8 and will be described in greater detail hereinafter. The fans 42 and 44 are driven by motors 50 and 52, respectively located outside of the refractory walls 18. The motors are each supported on a platform 54 and a pulley secured to the motor shaft is connected by a belt to a pulley secured to an end portion of fan shaft located externally of the recuperator.

Waste gases from section 4 pass through openings 20 and 22 to flow through recuperator 6 and openings 22 and 20 to flow through recuperator 8 and in each recuperator into side fan scrolls sections 28 and 30 through inlets 58 and 60. Fan 42 delivers waste gases through outlet 62 into the bottom chamber 40 and through holes in the bottom plate 36 against the bottom of strip S. Fan 44 delivers waste gases through outlet 64 into top chamber 38 and through the holes in the bottom plate 34 against the top of the strip S. A strip support roll 66 is provided between recuperators 6 and 8. A sliding door 68 is provided at the entry end of recuperator 8. Holes 70 are provided between side sections 28 and 30 which permit flow of gasses from one fan to top and bottom waste heat chambers 38 and 40 should the other fan becomes inoperative for any reason.

Referring now to FIGS. 7 and 8, the present invention provides an insulated plug assembly which is useful to form a closure for the opening in the sidewall of the recuperator at the site were the drive shaft for the fan extends exteriorly of the recuperator. The preferred form of the plug assembly includes a spaced apart and generally parallel exterior and interior face plate 72 and 74, respectfully. Each plate 72 and 74 takes the form of an annular ring. An outer hub ring 76 is secured to the annular edge 78 of a central annular opening in plate 72. An inner annular plate 80 of smaller diameter than plate 76 is secured to the annular edge 82 of a central annular opening in interior plate 74. Annular plates 76 and 80 are held in a spaced apart relation by spaced apart web plates 84 and 86. Plates 76, 80, 84 and 86 form a seal support housing that interconnects the exterior plate 72, and interior plate 74. A mechanical seal assembly 88 is carried by the seal support housing and centered to match the fan shaft.

An outer annular rim 90 is secured by weld about one annular edge thereof to the interiorly directed face surface of plate 72. Secured to the interiorly projecting edge portion of rim 90 are spaced apart annular rings 92 and 94 so as to form a gap therebetween of a sufficient size to slidably receive the outer peripheral edge portion of interior plate 74. This construction permits rapid radial expansion and contraction of interior plate 74 relative to the rim 90, as well as interior plate 72. The rapid dimensional changes due to thermal conditions in the jet recuperator are a result of rapid temperature change therein which is particularly acute when heat insulation used in the recuperator stores relatively small quantities of heat as compared for example to refractory brick. As noted previously, temperature fluctuation within the jet recuperator can be of the order of 1400 degrees Fahrenheit per minute of hot gas temperature increase at the fans.

The present invention further provides that tubular spacers 96 are arranged at spaced apart locations about a circle in the internal cavity situated between plates 72 and 74 so as to maintain the plates at a substantially uniform spacing even while one plate undergoes thermal expansion at a rate much greater than the other plate. The spacers are held in place by bolt members 98. A head portion of each bolt is supported by the hot face surface of plate 74 so that the shank portion extends inside the tubular spacer and an end portion protrudes from plate 72. On the end portion of each bolt there is first arranged a washer 100 which forms a support member for a compression spring 102 that is compressed to a predetermined loading by torque applied to a nut 104 which presses a washer 106 against the outer end of the spring. After the desired force has been established by compression of the spring, a second lock nut 108 is threaded onto the end portion of this bolt and jammed against the first nut. This arrangement of parts is provided at each spacer. An outer flange portion on the plate 72 is provided with a spaced apart arrangement of openings which receive fasteners used to attach the insulated plug assembly to the sidewall of a recuperator so as to form a closure for the opening therein. In the preferred form, the space between plates 72 and 74 is filled with heat insulative material 110 which can be in the form of kaowool ceramic fiber blanket packed to a predetermined density which can be maintained by the clamping force existing between the plates 72 and 74 through the use of the bolt 94 and the spring members.

While the present invention has been described in connection with the preferred embodiments shown in FIGS. 1–8, it is understood that other similar embodiments such as square, rectangular, octagon, etc. face plates may be used or modifications and additions may be made to the described embodiment for performing the same functions of the present invention without deviating therefrom. Therefore, the present invention should not be limited to any single in accordance with the recitation of the appended claims.

I claim:

1. In a heating apparatus having a housing and a plug assembly forming a side wall closure for a fan to operate in the housing, said plug assembly including the combination of:

inner and outer face plates spaced apart by spacers extending therebetween to form a heat insulative cavity, one of said face plates being exposed to rapidly changing temperatures in said housing while forming part of a side wall closure therefor;

fastening means for clamping said outer and inner face plates against said spacers;

hub means carried by said inner and outer face plates for rotatably sealing a drive shaft for said fan; and means secured to one of said inner and outer face plates for slidably supporting an outer peripheral portion of the other of said face plates during rapid radial expansion thereof.

2. The plug assembly according to claim 1 wherein said spacers include tube members having uniform lengths to maintain said face plates at a uniformly spaced apart relation.

3. The plug assembly according to claim 1 wherein said fastening means include bolt members having heat portions supported by one of said plates and end portions extending from the other of the plate;

resilient means received on the end portion of each of said bolts; and retaining member engaged with the end portion of each of said bolts to maintain said resilient means under a predetermined load for compressing sad face p lates against said spacers.

4. The plug assembly according to claim 1 wherein said hub means includes annular member rigidly interconnected to form a rigid interconnection between said face plates.

5. The plug assembly according to claim 1 wherein said means secured to one of said inner and outer face plates includes a circular rim plate; and spaced apart ring members carried by an inner peripheral surfaceof the rim plate for slidably supporting one of said face plates.

6. The plug assembly according to claim 5 wherein said circular rim plate is secured to the other of said face plates for support thereby.

7. The plug assembly according to claim 1 further including heat insulative means in said heat insulative cavity.

* * * * *

UNITED STATES PATENT OFFICE
CERTIFICATE OF CORRECTION

Patent No. 4,743,197 Dated May 10, 1988

Inventor(s) William M. Bloom

It is certified that error appears in the above-identified patent and that said Letters Patent are hereby corrected as shown below:

In the specification:

Column 5, line 14, after "any single" and before "in accordance", insert the phrase -- embodiments, but rather construed in breadth and scope --.

In the claims:

In claim 3, line 2, delete "heat" and substitute -- head --.

In claim 3, line 9, delete "sad" and substitute -- said --.

Signed and Sealed this

Eighteenth Day of October, 1988

*Attest:*

DONALD J. QUIGG

*Attesting Officer*

*Commissioner of Patents and Trademarks*